US005379938A

United States Patent [19]

Perret, Jr.

[11] Patent Number: 5,379,938

[45] Date of Patent: Jan. 10, 1995

[54] SEAL FOR AIRLESS SPRAY GUN

[75] Inventor: Robert J. Perret, Jr., Newport Beach, Calif.

[73] Assignee: A. S. M. Company, Inc., Orange, Calif.

[21] Appl. No.: 73,333

[22] Filed: Aug. 16, 1993

[51] Int. Cl.[6] ..... B05B 15/02

[52] U.S. Cl. ..... 239/119; 239/288.3; 239/DIG. 4

[58] Field of Search ..... 239/119, 288–288.5, 239/DIG. 4

[56] References Cited

U.S. PATENT DOCUMENTS

| | | | |
|---|---|---|---|
| 4,116,386 | 9/1978 | Calder | 239/119 |
| 4,157,163 | 6/1979 | Pinto et al. | 239/119 |
| 4,165,836 | 8/1979 | Eull | 239/119 |
| 4,256,260 | 3/1981 | Piggott | 239/119 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,513,913 | 4/1985 | Smith | 239/119 |
| 4,715,537 | 12/1987 | Calder | 239/119 |
| 4,757,947 | 7/1988 | Calder | 239/119 |

*Primary Examiner*—Karen B. Merritt

*Attorney, Agent, or Firm*—Plante & Strauss

[57] ABSTRACT

A spray tip assembly for airless fluid spraying includes the spray tip assembly and an adapter for mounting on a spray gun barrel. The spray tip assembly has a housing with a longitudinal through-running passage way in which a member carrying an orifice spray tip is mounted. The discharge end of the spray tip assembly includes a spray guard and the opposite end of the spray tip assembly is secured by the adapter to the barrel of a spray gun through which material to be sprayed is conducted to the spray tip assembly. In one embodiment of the invention the orifice of the spray tip assembly is carried in a cylindrical body which is rotatably mounted in the housing of the spray tip assembly so that the orifice can be reversed for cleaning purposes. In another embodiment the orifice is fixedly seated in the tip assembly and is not reversible. Components of the assembly are secured by at least one threaded locking element and sealing between components of the assembly is provided by annular polytetrafluorethylene resin sealing members having a compression ratio of between about 20% and about 40% to effect sealing between components simply by hand tightening the locking element.

11 Claims, 3 Drawing Sheets

SEAL FOR AIRLESS SPRAY GUN

FIELD OF THE INVENTION

This invention relates to airless spray equipment and more particularly to an improved seal for hand tightened spray guns.

BACKGROUND OF THE INVENTION

Airless spray equipment includes the spray gun which has an orifice through which the liquid being sprayed, normally paint, is forced under high pressure. The spray gun further includes a trigger mechanism for initiating and terminating the spray operation. In view of the high pressure under which the liquid being sprayed exits the nozzle of the spray gun, the spray tip of the spray gun is provided with a guard to prevent contact with the spray pattern at close range, which contact could result in physical injury. The spray tip is normally designed so that the orifice at the nozzle end of the gun can be changed to vary the pattern of the spray and in many spray tip designs the orifice can also be rotated to reverse flow through the orifice for cleaning purposes. The components of the spray gun must be provided with sealing members such as "O" rings to maintain the components in a fluid tight relationship in order to avoid leakage of the high pressure fluid during operation of the gun.

During spraying operations it is often necessary to partially or completely disassemble the spray gun in order to change the orifice or to the rotate the spray guard to change the orientation of the spray pattern. The spray gun components are normally wrench tightened in order to obtain maximum compression sealing between the components and the sealing members. Consequently a substantial amount of time can be consumed in disassembling, either partially or completely, the spray gun to make the necessary changes and reassembling the components. In certain cases the components may not reseal properly and additional time must be utilized in reassembling the components to obtain the proper seal.

SUMMARY OF THE INVENTION

This invention comprises a spray tip assembly including a spray guard, an orifice tip holder that, in one embodiment, is reversible between a spraying position and a cleaning position and which is removable and interchangeable with other spray tip holders supporting orifice tips of varying diameter and capacity. In accordance with the invention the components are provided with sealing members which have a sufficient compression ratio to maintain sealing pressure between adjacent components when hand tightened so that the spray tip assembly is easily assembled and disassembled without the necessity of the use of tools. The sealing member is an annular shaped body formed of a resilient plastic material which is solvent resistant. The sealing member asserts sufficient compressive force between adjacent components of the assembly to provide a fluid tight seal against the leakage of the high pressure material being sprayed when the components are tightened by hand.

In further detail the assembly of the present invention includes the spray tip assembly which has a housing with a longitudinal through-running passage way and an intersecting orthogonal bore in which a member carrying an orifice spray tip is rotatably mounted. The discharge end of the spray tip assembly includes a spray guard and the opposite end of the spray tip assembly is secured to the barrel of a spray gun through which material to be sprayed is conducted to the spray tip assembly. In one embodiment of the invention the orifice of the spray tip assembly is carried in a cylindrical body which is rotatably carried in the housing of the spray tip assembly so that the orifice can be reversed for cleaning purposes. In another embodiment the orifice is fixedly seated in the tip assembly and is not reversible. Components of the assembly are secured by at least one threaded locking element and in accordance with the present invention sealing between components of the assembly is provided by annular sealing members having a compression ratio of between about 20% and about 40% to effect sealing between components simply by hand tightening the locking element.

BRIEF DESCRIPTION OF THE DRAWINGS

The invention will described with reference to the illustrated and presently preferred embodiment of the invention of which.

DETAILED DESCRIPTION OF THE INVENTION

Figure 1:
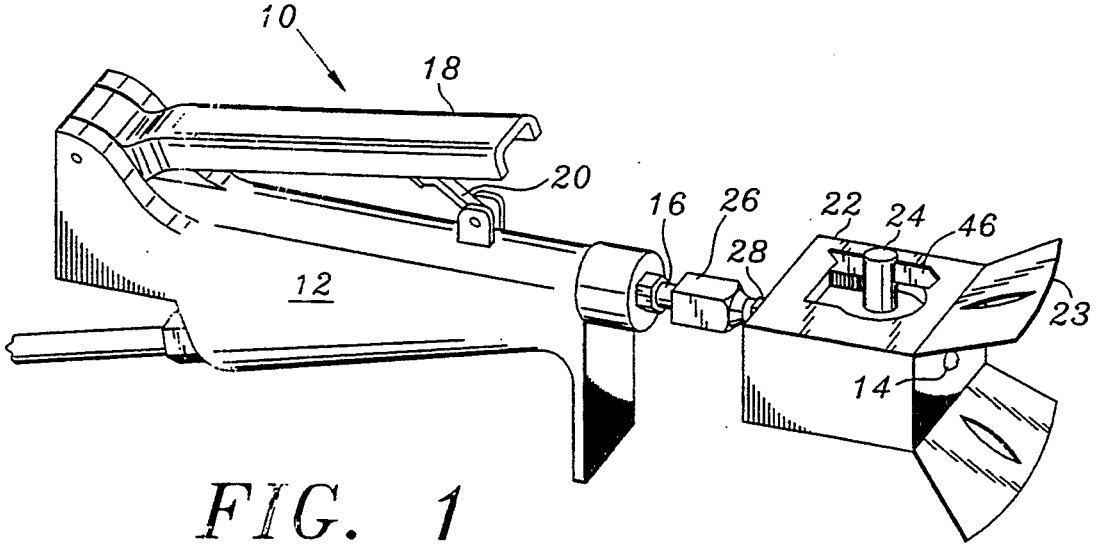
FIG. 1 is a perspective view of a spray gun fitted with a spray nozzle having hand tightened components in accordance with the invention.

Referring now to FIG. 1, the invention is generally indicated by a spraying device 10 comprising a spray gun 12 to which a spray nozzle 14 is removably attached. The illustrated spray gun 12 has a barrel 16 for discharge of pressurized liquid therefrom in response to movement of an internal valve mechanism controlled by a lever 18. Suitable lock means such as a link 20 is indicated on the housing of the spray gun 12 to lock the lever 18 in a closed valve position whereby the pressurized liquid cannot be accidentally discharged. The link 20 is pivotally mounted on the spray gun 12 for forward movement to release the lock and permit one to pivot the lever 18 to open the spray gun valve. The pressurized liquid is supplied through a conduit which communicates into the barrel 16 of the spray gun 12.

The spray nozzle 14 includes a body 22 from which a pair of generally parallel guard blades 23 project outwardly from the body. The blades 23 provide a safety feature by serving as protective shields to obstruct entry of a finger or limb into the spray pattern as it is discharged from the nozzle 14. The body 22 also rotatably supports a turret member 24 which can be rotated by means of a handle 46 between a spraying position, as illustrated, and a reversed cleaning position. The body 22 is carried in the assembly on an adapter 26 which has a through running bore 25 for fluid communication between the barrel 16 and the body 22 and a larger threaded counter bore 27 extending part way through the adapter. The adapter 26 is secured to the threaded discharge end of the barrel 16 and the body 22 is secured on the adapter 26 by a retainer nut 28.

Figure 2:
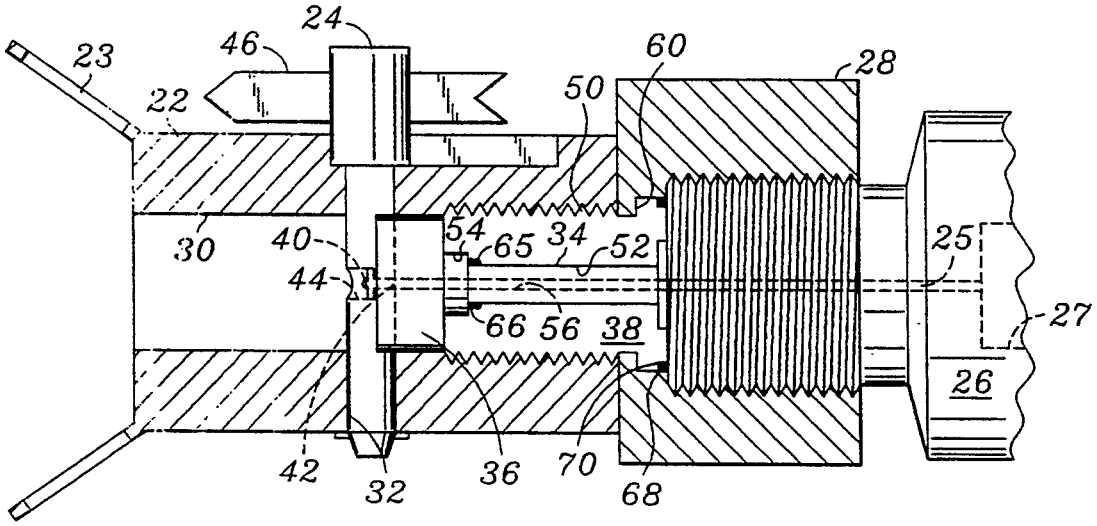
FIG. 2 is a side sectional view in enlarged scale of a spray nozzle including sealing members and hand tightened adjacent components in accordance with the present invention.
Figure 3:
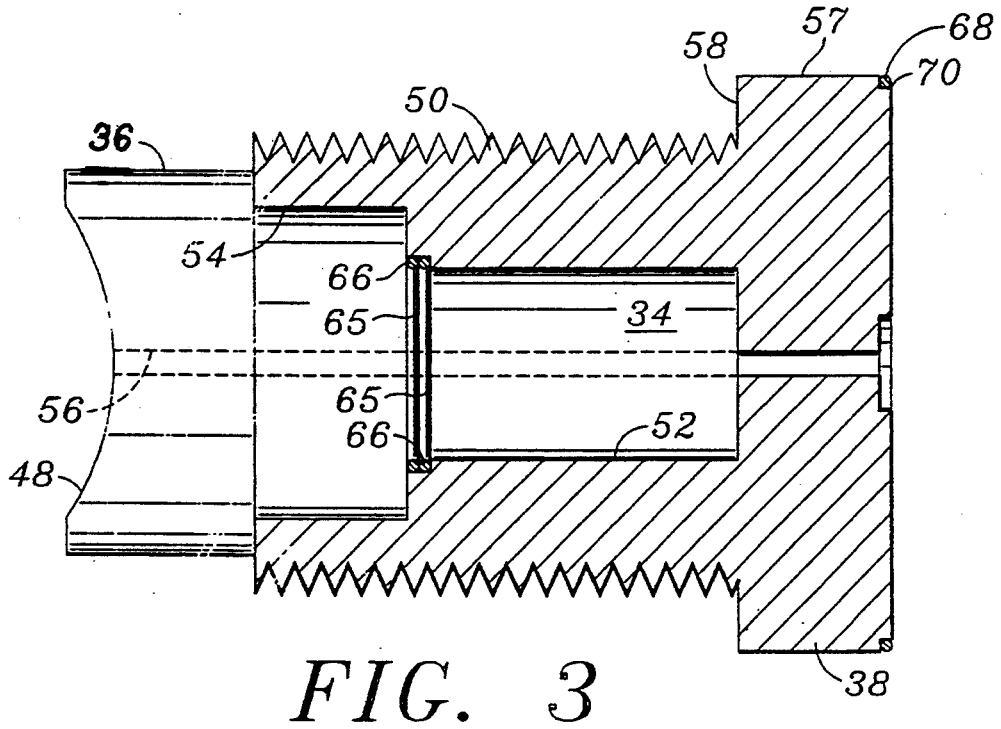
FIG. 3 is an side view, partially in section, in enlarged scale of the retainer assembly of FIG. 2.

Referring now to FIGS. 2 and 3, the body 22 of the spray nozzle 14 has a through running passage 30 which opens to the front and rear faces of the body. An orthogonal bore 32 opens at the top and bottom of the body 22 and intersects the through running passage 30. The rotatable turret 24 is received in the orthogonal bore 32 and is sealingly and rotatably secured therein by a retainer assembly which is disposed in the passage 30 and which includes a piston 34 having a sealing head 36 and a retainer 38 for securing the piston against the turret 24. The turret 24 carries a orifice member 40 which communicates with a transverse bore 42. A portion of the transverse bore 42 is enlarged at 44 to receive the orifice member 40 so that the orifice member does not extend beyond the cylindrical surface of the turret 24. The turret 24 is sealed in the assembly by the retainer assembly which, as is most clearly shown in FIG. 3, includes the piston 34 carrying the enlarged sealing head 36 which has a concave face 48 configured to provide a continuous mating surface with the cylindrical outer surface of the turret 24. The body of the piston 34 is received in the retainer 38 which includes a cylindrical threaded shaft 50 having a bore 52 and a larger counterbore 54 for receiving the body of the piston 34 and the enlarged sealing head 36. A bore 56 extends through the piston 34 and the retainer 38 for communication with the transverse bore 42 of the turret 24 and the bore of the adapter 26. The adapter 26 has its forward face bearing against the rear face of the retainer 38 thereby biasing the concave face 48 of the piston 34 against the side of the cylindrical turret 24. The upstream end of the retainer 38 is enlarged at 57 to define a bearing surface 58. The retainer nut 28 is inwardly turned at its inner end to define a radially inwardly extending flange 60 which is disposed between the rear surface of the body 22 and the bearing surface 58 of the retainer 38 to secure the spray tip assembly on the barrel 16 of the spray gun 12.

Sealing of the assembly against leakage of the high pressure fluid being sprayed is provided by several annular sealing members having sufficiently high compression ratios to effectively provide a fluid tight seal when subjected to manually generated compressive force. The body of the piston 34 is provided with a circumferential groove 65 in which are disposed a pair of resilient O-rings 66 which act against shoulders defined by the counter bore 54 and the bore 52 to seal the piston body in the retainer and to provide a spring action for urging the concave face 48 of the sealing head 36 against the cylindrical contour of the turret 24. A sealing O-ring 68 is disposed in a corresponding groove 70 formed about the periphery of the enlarged portion 57 of the retainer 38. The O-ring is compressed against the adapter 26 by the extending (see FIG. 2) flange 60 of the retainer nut 28 acting against the bearing surface 58 (see FIG. 3) as the retainer nut is drawn up on the adapter.

Figure 4:
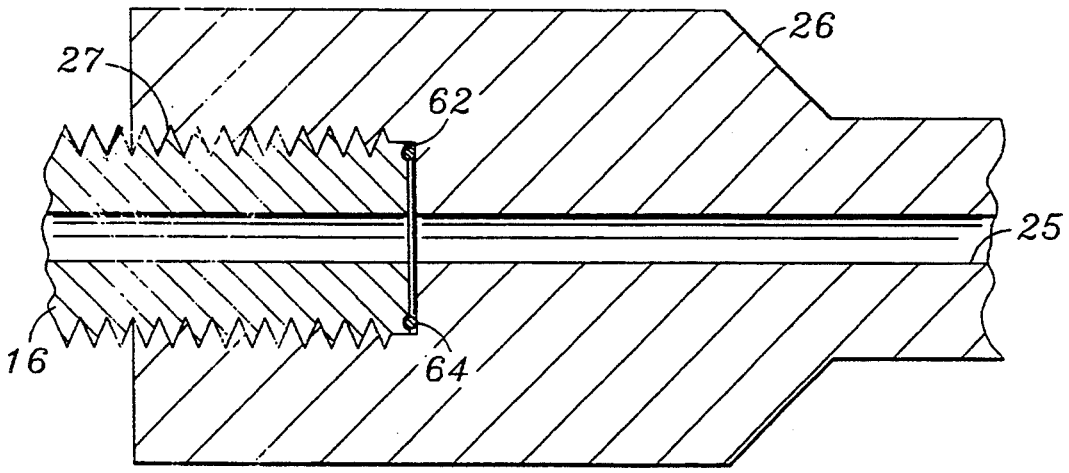
FIG. 4 is a sectional view in enlarged scale showing the attachment of the adapter on the barrel of the spray gun.

As is most clearly shown in FIG. 4, the discharge end of the barrel 16 of the spray gun 12 is provided with a groove 62 in which is received a resilient sealing member 64. In the assembled state the sealing member 64 is compressed against the discharge end of the barrel 16 and a shoulder formed at the juncture of the counter bore 27 and the through-running bore 25 of the adapter 26 and exerts compressive force thereagainst to provide a fluid tight seal when the adapter is drawn down on the barrel 16.

In accordance with the invention, the O-rings utilized as the sealing members in the assembly are formed from resilient Teflon having a compression ratio of 30%. The Teflon has the necessary characteristics of resiliency, compression ratio, and solvent resistance to permit its use as the sealing material for the hand tightened spray gun 12 of the present invention. Other materials, such as butylene and butydiene, although possessing the necessary inertness with respect to the solvents, are unsatisfactory because they do not have the required compression ratio to provide the requisite compressive sealing function between adjacent components when subjected to manual compression.

Figure 5:
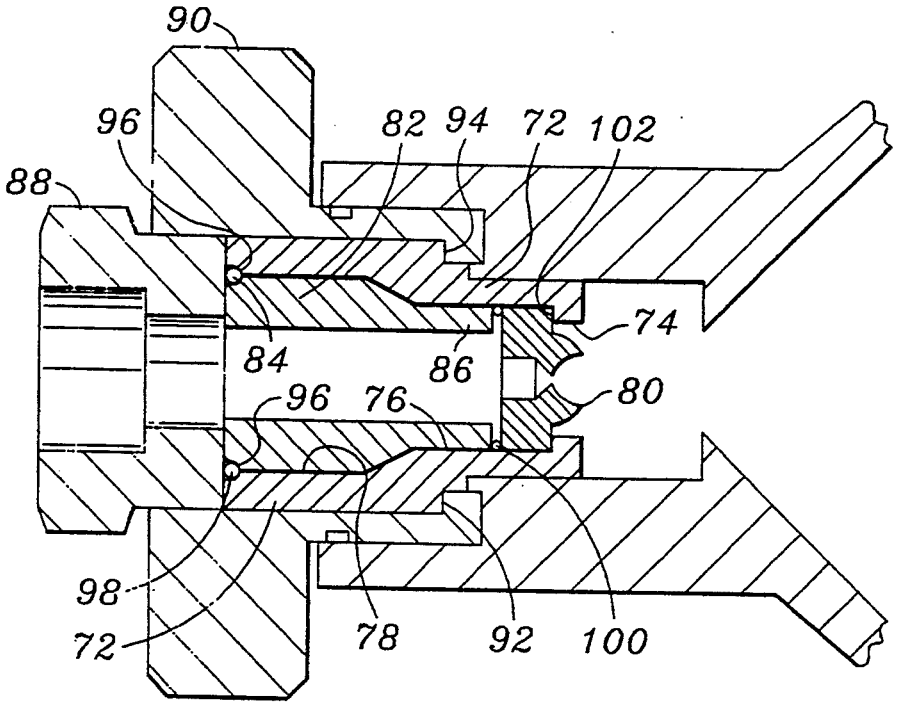
FIG. 5 is a side sectional view in enlarged scale of another embodiment of a spray nozzle having sealing members and hand tightened adjacent components.

Referring to FIG. 5, another embodiment of the invention is illustrated. In this embodiment the spray tip assembly includes a case 72 having a through running bore 74 and two counter bores 76 and 78 of increased diameter. The inside diameter of the larger counter bore 78 is threaded. A carbide tip 80 defining the spray orifice is disposed in the bore 74 at the down stream end of the case 72. A retainer 82 having a portion 84 of enlarged outer diameter and a portion 86 of reduced outer diameter is received in the counter bores 76 and 78 of the case 72. The outer surface of the enlarged portion 84 of the retainer 82 is provided with threads for engagement with the threads of the case 72. The case 72 is secured on an adapter 88 by a retainer nut 90 inwardly turned at the downstream end to define a radially inwardly extending flange 92 which acts against a shoulder 94 formed on the case 72 to draw the case 72 and the retainer 82 against the inner face of the adapter 88. Oppositely facing notches are provided in the peripheral upstream ends of the case 72 and the retainer 82 to define a groove 96 when the two parts are assembled. A resilient sealing member 98 of the type described above in connection with FIG. 2 is disposed in the groove 96. A portion of the circumference of the sealing member 98 extends outwardly of the groove 96 and so that the sealing member 98 is compressed when the retainer 82 and case 72 are drawn against the inner face of the adapter 88. When compressed, the resilient sealing member 98 maintains a compression seal even though the retainer nut 90 is hand tightened. A sealing member 100 is also provided at the downstream end of the retainer 82 to provide a compression seal between the retainer 82, the carbide tip 80 and a shoulder 102 formed at the discharge end of the case 72. In this embodiment the carbide tip 80 is not reversible.

In accordance with the invention the sealing members at the various locations in the spray gun 12 assembly as indicated have a sufficiently high compression ratio to be readily compressed by hand tightening of the retainer nut to maintain a compressive seal without the necessity of wrench tightening the components or retainer nut. In operation the retainer nut can be turned back to release the compression on the sealing members and to allow the spray guard the body to be easily rotated into a desired position and sealing reestablished by simply backing the nut down to hand tightness. By the same token the nozzle assemblies are readily disassembled without the necessity of the use of tools and upon reassembly, sealing is readily reestablished by simply hand tightening the retainer nut.

As will be understood, various arrangements other than those described in detail in this specifications will occur to persons skilled in the art, which arrangements lie within the spirit and scope of the invention. It is therefore to be understood that the invention is to be limited only by the claims appended here to.

Having described the invention I claim:

1. An assembly for high pressure fluid spraying, said assembly having components including a housing having a barrel including a bore opening to a discharge end thereof, a conduit for supplying fluid under pressure from a source through said bore of said barrel for discharge from said discharge end thereof, valve means for controlling the flow of said pressurized fluid, a spray nozzle removably carried at said discharge end of said barrel, an adapter member for attaching said spray nozzle on said barrel and means for securing said spray nozzle on said adapter member, said adapter member having a through-running bore for fluid communication between the discharge end of said barrel and said spray nozzle and a larger diameter, threaded counter bore extending part way through said adapter member to provide an internal annular shoulder therein which threadably receives the discharge end of said barrel against said internal annular shoulder, an annular groove and resilient sealing means received in said groove between said internal annual shoulder and said barrel, said resilient sealing means consisting of a compressible sealing ring received in said annular groove, said sealing ring being inert to fluid being sprayed and having a compression ratio effective to maintain a fluid tight seal between components when said sealing ring is subjected to manually generated compressive force, whereby, in the assembled state, said sealing ring is compressed between the discharge end of said barrel and said shoulder and exerts compressive force thereagainst to provide a seal between said adapter member and said barrel, said spray nozzle including a spray tip body with a longitudinal through-running bore opening to front and rear faces of said body, and a spray tip comprising a spray guard and an orifice member for defining a spray pattern for said pressurized fluid.

2. The assembly of claim 1 wherein said sealing ring comprises at least one annular polytetrafluorethylene resin sealing member having a compression ratio of between about 20% and about 40%.

3. The assembly of claim 2 wherein said sealing member has compression ratio of 30%.

4. The assembly of claim 1 wherein said spray tip body further includes an orthogonal bore intersecting said longitudinal bore, a rotatable cylindrical turret member carrying said orifice member is received in said orthogonal bore, a retainer is disposed in said longitudinal through-running bore, said retainer including a piston and second resilient sealing means therefor, said piston having a bore extending therethrough and an enlarged sealing head for sealing contact with said turret member and said retainer having an upstream and a downstream end, said retainer comprising a threaded shaft having a through-running bore opening at said upstream end and a larger counterbore communicating with said through-running bore and opening at said downstream end thereof for receiving said piston, and said second resilient sealing means includes a circumferential groove in which are disposed a pair of resilient annular sealing rings which act on the wall of said counterbore of said retainer and against shoulders defined at the terminus of said counter bore in said retainer to seal said piston in said retainer and to provide a spring action for urging said sealing head against a contour of said cylindrical turret member.

5. The assembly of claim 4 wherein the upstream end of said retainer is enlarged to define a bearing surface on the surface facing downstream for contact with a rear face of said spray tip body and an opposite surface for contact with said adapter member, a groove is formed about a periphery of said enlarged portion adjacent the opposite surface, third resilient sealing means which comprises a resilient O-ring which is disposed in said groove and is compressed against the end of said adapter member to provide a fluid tight seal between said spray nozzle and said adapter member when said third resilient sealing means are subjected to manually generated compressive force.

6. The assembly of claim 5 wherein said resilient O-ring comprises an annular polytetrafluoroethylene resin member having a compression ratio of between about 20% and about 40%.

7. The assembly of claim 5 wherein said resilient O-ring comprises an annular polytetrafluoroethylene resin member having a compression ratio of 30%.

8. The assembly of a spray tip comprising a spray guard and an orifice member for defining a spray pattern for said pressurized fluid within a spray tip case having a downstream end with an external annular shoulder and an upstream end, a through-running bore opening at both ends thereof with a threaded counter bore of enlarged diameter opening at the downstream end of said case, a carbide body defining the orifice member disposed in said counter bore for discharge through the downstream end of said case, a retainer member having external threads threadably secured in said threaded counter bore, an adapter member, a locking nut secured on said adapter and having, at its downstream end, a radially inwardly extending flange which is received over said external annular shoulder on said case to draw said case and said retainer member against said adapter member for securing the components thereon, oppositely facing corresponding notches in the upstream end of said case and said retainer member to define a groove when the two components are assembled and a resilient sealing member disposed in the groove defined therebetween, said resilient sealing member being compressed when said retainer member and case are drawn against said adapter member by said locking nut.

9. The assembly of claim 8 wherein said resilient sealing member comprises an polytetrafluoroethylene resin O-ring having a compression ratio of between about 20% and about 40%.

10. The assembly of claim 8 wherein said resilient sealing member comprises an polytetrafluoroethylene resin O-ring having a compression ratio of 30%.

11. The assembly of claim 8 including the additional resilient sealing means disposed between the downstream end of said retainer and said carbide body.

* * * * *